US006120253A

United States Patent [19]

Graves

[11] Patent Number: 6,120,253

[45] Date of Patent: Sep. 19, 2000

[54] CENTRIFUGE GAS AND LIQUID PISTON COMPRESSOR

[76] Inventor: William F. Graves, 7606 Van Dyke Rd., Tampa, Fla. 33556

[21] Appl. No.: 09/175,105

[22] Filed: Oct. 19, 1998

[51] Int. Cl.[7] ..... F04C 19/00; F04D 29/54

[52] U.S. Cl. ..... 417/68; 417/67; 417/423.5; 415/206

[58] Field of Search ..... 417/68, 70, 66, 417/67, 205, 423.4, 423.7, 420, 423.5; 415/90, 900, 203, 206

[56] References Cited

U.S. PATENT DOCUMENTS

| | | | |
|---|---|---|---|
| 885,108 | 4/1908 | Trent | 415/206 |
| 2,472,412 | 6/1949 | Fritz | 415/203 |
| 3,647,314 | 3/1972 | Laessig | 415/206 |
| 5,540,550 | 7/1996 | Kubota | 416/179 |

*Primary Examiner*—Teresa Walberg
*Assistant Examiner*—Thor Campbell

[57] ABSTRACT

A centrifuge gas compressor for compressing gases to higher pressure states having a housing hollow interior, inside the hollow interior is a distributor and a rotating disc; the distributor is used for channeling gas and liquids into the rotating disc. The rotating disc contains a multiplicity of compression conduits extending perpendicular from a rotating axis of said disc whereby gas and liquids are channeled through. The spinning disc creates centrifugal force on the gas and liquid mixture and forces the mixtures towards smaller exit openings thereby compressing the gas in the process. The compressed gas then exits the spinning disc at a perimeter opening whereby the high-pressure gas can be used for its intended purpose.

8 Claims, 14 Drawing Sheets

INTERMITTENT LIQUID PISTON

VOLUME OF GAS CHAMBERS (G)3>(G)2>(G)1

PRESSURE OF GAS CHAMBERS (P)3 < (P)2 < (P)1

CENTRIFUGE GAS AND LIQUID PISTON COMPRESSOR

BACKGROUND

1. Field of the Invention

Generally, this invention is directed towards a compressor for compressing various types of gases. More specifically, this compressor uses a centrifuge type configuration with a unique liquid piston system to assist in compressing gases from a low-pressure state to high-pressure state.

2. Description of the Prior Art

Compressors have been around for many years and have been used in a wide variety of applications. Many refrigeration systems use reciprocating compressors to compress gases to a higher state of pressure and using these high-pressure gases to perform the specific duty of removing heat from a reservoir. Other reciprocating compressors are used for compressing air into storage tanks of higher pressures, and most reciprocating compressors seem to be used in automobile engines to compress a mixture of explosive gasses prior to detonation.

In refrigeration, a problem encountered with many reciprocating compressors is their inability to vary capacity during operation. Another drawback to reciprocating compressors is the internal friction among moving parts, which decreases the life and efficiency of the compressor. Additionally still, is that reciprocating compressors must operate in a clean or contaminant free environment in order to operate effectively. Not mentioning low efficiency, these are just a few of the limitations of most reciprocating compressors and the design of some centrifuge type compressors.

Of the known reciprocating compressors, most seem to use solid pistons to compress compressible gases from a low-pressure state to a high-pressure state. A multiplicity of intricate parts are needed to work precisely together and perform the specific function of compressing gases to a higher pressure state. A problem with these types of systems is the friction that arises between the moving parts of the system. The system needs to be properly lubricated continuously or kinetic friction between the moving parts will damage and shorten the life expectancy of the compressor. The pistons and other moving parts of the compressor eventually wear out and must be rebuilt periodically.

The basic relation or equation used for ideal gases (equation of state) is the relationship $PV=nRT$; where T is the absolute temperature of the gas in degrees Kelvin, V is the volume of the gas, P is the pressure of the gas, n is the number of moles of the gas, and R is a universal constant. Note an ideal gas is one that obeys the equation of state. Liquids contains characteristics similar to solids in that they are generally materials that are non-compressible, however, liquids also contains characteristics of gases in that they take on the shape of their container. It is an intent of this invention to use the characteristics of most liquids and gases with a centrifuge compressor design that will allow the liquid to act as a piston to compress gases from a low pressure state to a high pressure state.

Several approaches have been provided for improved compressor designs, in U.S. Pat. No. 5,555,956, "An improved motor driven centrifugal refrigerant compressor is disclosed having a housing enclosing a motor, control electronics and moving parts of the compressor, and a fluid pathway for circulation a mixture of low pressure refrigerant and a lubricant around the pathway, the pathway including a lubricant concentrator for coalescing the lubricant of the mixture to lubricate moving parts of the compressor and the pathway also including a convective heat transfer region to cool the motor and control electronics within the housing ."

In U.S. Pat. No. 3,650,634, "In a centrifugal compressor a sealed annular space is established between the backside of the impeller and the housing wall. Pump means is provided to maintain a minimum pressure in the annular space at a level above the pressure in the bearing structure mounted in the housing wall. The arrangement prevents the passage of oil from the bearing structure to the area behind the impeller when the discharge pressure falls to an abnormally low level."

In U.S. Pat. No. 3,650,634, "A refrigeration system is provided with a centrifugal refrigerant gas compressor having moveable capacity control means in its inlet and a fluid pressure responsive piston is movable to move the capacity control means accordingly. First and second solenoid operated fluid valves are arranged to be normally deenergized in a system to supply fluid pressure equally to its sides if the outside and maintain the capacity control immovable at a particular capacity position. When a respective one of the valves, is energized, the piston w3ill be moved in a respective direction to change the position of the capacity control and increase or lower the capacity control, accordingly. A refrigeration system condition sensing control responds to provide a respective electric energizing signal to the respective electric energizing signal to the respective valve solenoid in the form of an intermittent signal increasing in frequency and/or duty cycle to a continuous signal as the sensed condition lowers or rises from a preset condition, respectively, thus increasing capacity control sensitivity without instability about the preset condition."

In U.S. Pat. No. 5,136,854, a "Centrifugal gas compressor-expander where low temperature level energy rejected from the condenser is recovered and used to produce kinetic energy to assist driving the compressor, and thus reducing the electric power required for refrigeration."

While some of the prior art may contain some similarities relating to the present invention, none of them teaches, suggest or include all of the advantages and unique features of a centrifuge gas and liquid piston compressor for compressing gases. For the foregoing reasons, there is a need for a compressor that will efficiently compress gases from a low pressure state to high pressure state and can easily be used for a multiplicity of applications while not experiencing the current problems that occur with most reciprocating and centrifugal type compressors.

SUMMARY

The present invention is directed towards a centrifugal type compressor that is assisted by intermittent liquid pistons for purposes of compressing gaseous related substances. A unique gas liquid dispenser or distributor fuels a combination of liquid and gas into a multiplicity of entrance cavity openings. These entrance cavity openings are internal conduits or channels of a disc like object, whereby the channel gradually narrower in diameter as they reach the perimeter of the disc before exiting. These exit cavity openings normally are much smaller than the entrance openings or about a ten to one ratio. An electric motor and gear system is mechanically affixed to the disc and spins the disc to a given frequency. Next, the distributor then funnels a combination of liquid and gas into the opening channels whereby the liquid gas mixture travels towards the perimeter of the channels whereby the gas is squeezed to a smaller and smaller volume before exiting the exit openings. The combination liquid gas mixture is than separated by a multiplicity of different means and the liquid and is returned to the distributor apparatus to complete the cycle. The high pressure state of the gas can then utilized for whatever purpose it is intended.

Accordingly, it is a general object of this invention to provide a compressor that will compress a gas from a low-pressure state to a high-pressure state.

Another object of this invention is to provide a centrifugal type compressor that is assisted by liquid for purposes of compressing gaseous related substances in an effective and efficient manner.

Still, another object of this invention is to provide a centrifugal type compressor having a distributor that will intermittently channel liquids and gases into a spinning disc for gas compression.

A further object of this invention to provide a centrifugal type compressor having a compression conduit that will compress gases while the gases move from the inside of the disc towards the outside of the disc.

Still a further object of this invention to provide a centrifugal type compressor having a compression conduit which contains opening that are substantially circular in shape.

Still yet, a further object of this invention to provide a centrifugal type compressor having a compression conduit, which contains opening, that is substantially rectangular in shape.

Another object of this invention to provide a centrifugal type compressor having a distributor that will continuously channel liquids and gases into a spinning disc for gas compression.

Still another object of this invention to provide a centrifugal type compressor having a gas/liquid separator that will separate the high pressure gas/liquid mixture into separate gas liquid state for return back to the distributor.

Still yet, another object of this invention is to provide a centrifugal type compressor having control valves that will regulate the amount and ratio of gas/liquid entering the distributor. The control valves are computer controlled to find the optimum ratio for the most efficient compression cycle.

A further object of this invention is to provide a centrifugal type compressor having a disc with a plurality of compression conduits therein for increasing the capacity of the compressor.

Still a further object of this invention is to provide a centrifugal type compressor having a plurality of discs stacked in layers for increasing the capacity of the compressor.

Still yet, a further object of this invention is to provide a centrifugal type compressor having a variable speed motor to increase the RPM of the disc and thereby varying the capacity of the compressor.

Other objects and a fuller understanding of the invention will become apparent from reading the following detailed Description of a preferred embodiment in conjunction with the accompanying drawings.

BRIEF DESCRIPTION OF THE DRAWINGS

This invention, together with other objects, features, aspects and advantages thereof, will be more clearly understood from the following description, considered in conjunction with the accompanying drawings.

Fourteen sheets of drawings are furnished, sheet one contains FIG. 1, sheet two contains FIG. 2, sheet three contains FIG. 3, sheet four contains FIG. 4, sheet five contains FIG. 5, sheet six contains FIG. 6, sheet seven contains FIG. 7, sheet eight contains FIG. 8, sheet nine contains FIG. 9, sheet ten contains FIG. 10, sheet eleven contains FIG. 11, sheet twelve contains FIG. 12, sheet thirteen contains FIG. 13, and sheet fourteen contains FIG. 14.

LIST OF ELEMENTS

1. COMPRESSOR
2. GAS CONDUIT

3. LIQUID CONDUIT
4. LIQUID SOURCE
5. CENTER OF LIQUID SOURCE
6. CONICAL DEFLECTION PLATE
7. GAS DISTRIBUTOR
8. TOP SUPPORTING MEMBER OF LIQUID CONDUIT
9. TOP OPENING OF GAS CONDUIT
10. SIDE OF LIQUID DISTRIBUTOR
11. TOP OF LIQUID DISTRIBUTOR
12. LIQUID DISTRIBUTOR
13. LIQUID LINE
14. GAS LINE
15. GAS INLET OPENING
16. TOP OF GAS DISTRIBUTOR
17. BOTTOM PLATE OF DISTRIBUTOR
18. CIRCULAR OUTLET OPENING
19. COMPRESSOR HOUSING
20. COMPRESSOR DISC
21. HIGH PRESSURE CHAMBER
22. RECTANGULAR OPENING
23. LOWER SEAL
24. HIGH PRESSURE GAS/LIQUID EXIT OPENING
25. HIGH PRESSURE GAS/LIQUID EXIT CONDUIT
26. MOTOR SHAFT
27. PERIMETER COMPRESSOR HOUSING
28. GAS INPUT VALVE/REGULATOR
29. LIQUID INPUT VALVE/REGULATOR
30. GAS/LIQUID SEPARATOR
31. LIQUID PISTON (L)
32. LOW PRESSURE GAS (G)3
33. MEDIUM PRESSURE GAS (G)2
34. HIGH PRESSURE GAS (G)1
35. GAS DIRECTION, when compressor is in operation
36. LIQUID DIRECTION, when compressor is in operation
37. POSTERIOR EDGE OF LIQUID PISTON
38. ANTERIOR EDGE OF LIQUID PISTON
39. GAS/LIQUID DISTRIBUTOR
40. DISTRIBUTOR GAS/LIQUID SOURCE
41. INTERNAL CONDUIT OPENING
42. EXTERNAL CONDUIT OPENING
43. CONDUIT
44. AIR FILTER
45. COMPRESSED AIR TANK
46. HIGH PRESSURE GAS/LIQUID MIXTURE
47. LIQUID RETURN LINE
48. GAS RETURN LINE
49. GAS EXIT LINE
50. CONDENSOR
51. EVAPORATOR
52. CONDUIT
53. LIQUID INLET OPENING
54. CONICAL DEFLECTOR PLATE
55. DISC PERIMETER

DESCRIPTION OF THE PREFERRED EMBODIMENTS

Figure 1:
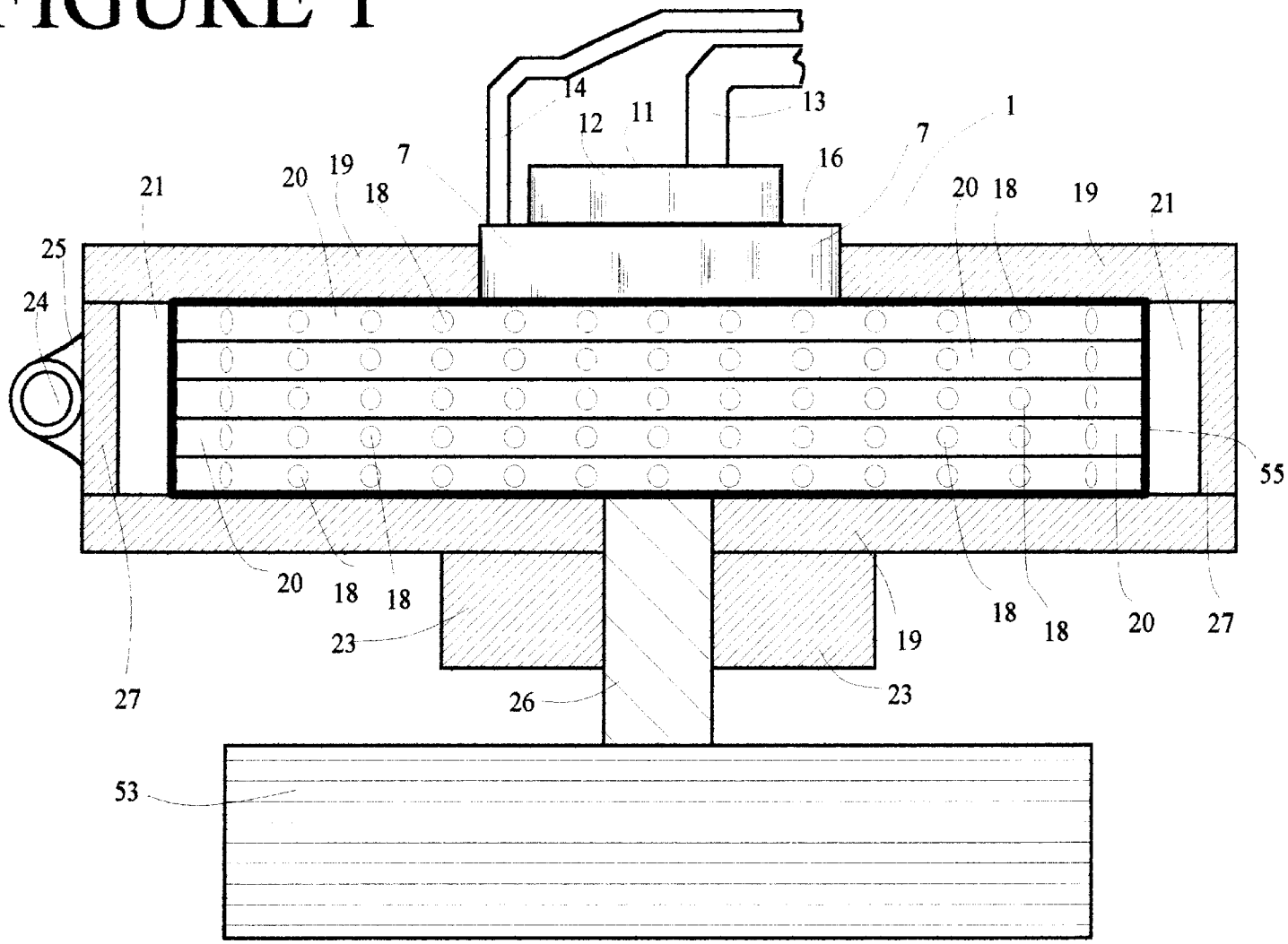
FIG. 1 shows a side cut-away view of the general components of the compressor having a motor and shaft propulsion mechanism, a housing for the spinning disc, a multiplicity of circular conduits, and a distributor to funnel gas and liquids into the spinning disc.
Figure 6:
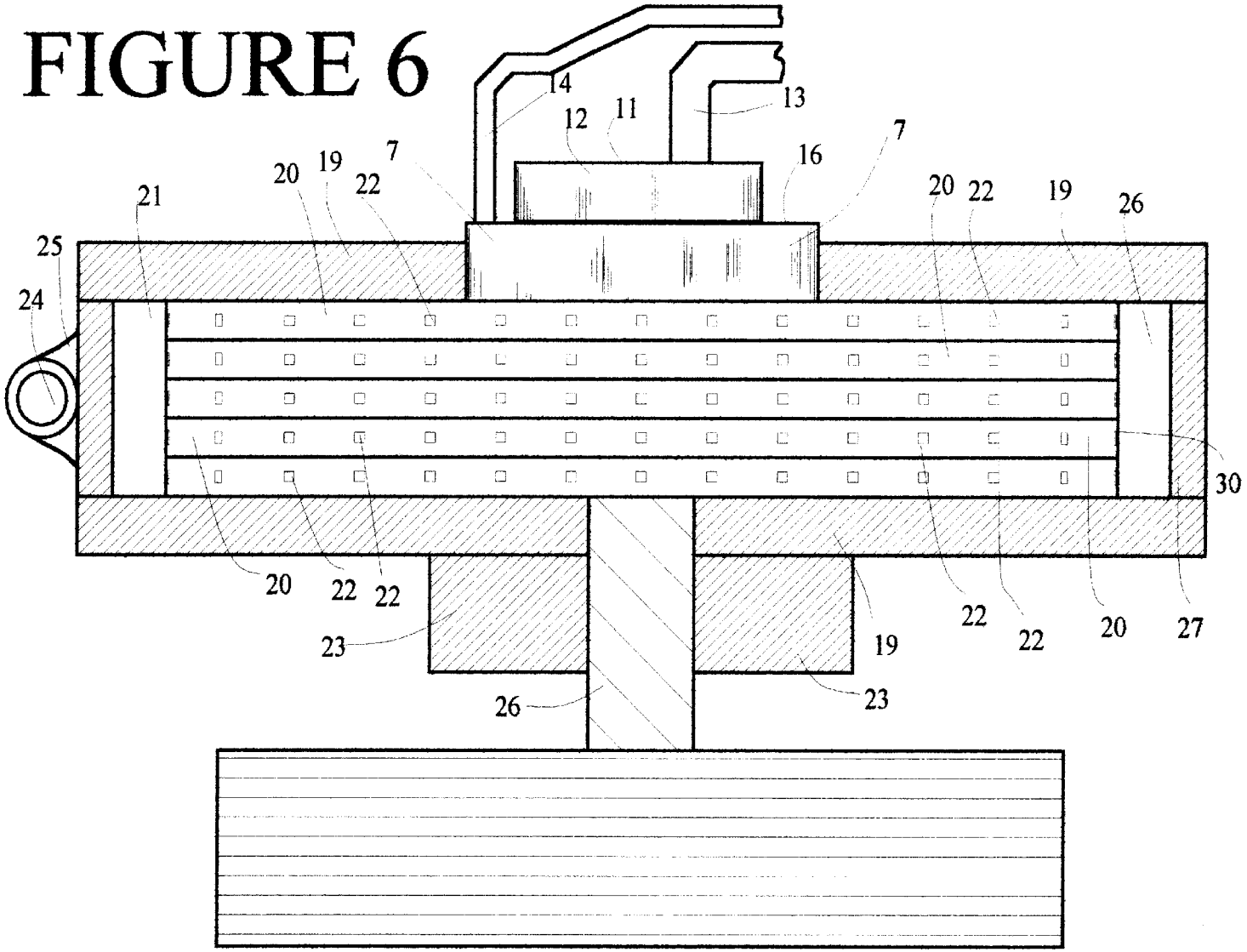
FIG. 6 shows a side cut-away view of the general components of the compressor having a motor and shaft propulsion mechanism, a housing for the spinning disc, a multiplicity of rectangular conduits, and a distributor to funnel gas and liquids into the spinning disc.

Referring now to FIGS. 1 and 6, a cross section view of a centrifuge gas compressor for compressing gases to higher pressures generally referred to by reference numeral 1 contains generally the elements of multiple discs 20, a motor shaft 26, a gas/liquid distributor 12, a housing 19, and motor 53. At the top of FIGS. 1 and 6, are distributors shown with two inlets lines; one for liquid 13, and one for gas 14. Five discs 20 are shown stacked on top of each other to form a layered configuration. Note, the number of discs 20 can be added or subtracted to increase or decrease the capacity of the compressor respectively. At the bottom side of the discs 20, a motor shaft 26 is affixed to the discs 20 with a motor 53 affixed at the opposite end. The motor 53 is a variable speed motor for allowing for adjustment of the spin speed of the discs 20 thereby allowing for varying capacity of the compressor. The stack of discs 20 are encased in a housing 19 and perimeter housing 27. Note, the housing 19 and 27 is sealed from the outside atmosphere to prevent leakage of the internal gas/liquid. The perimeter housing 27 is spaced a given distance away from the perimeter 55 of the spinning discs 20 to form a high pressure chamber 21. A tight seal between the discs 20 and the housings 19 and 27 to prevents leakage of the internal gases and liquids. At the bottom, a bearing and housing 23 is provided to seal and support motor shaft 26 while spinning the discs 20. In FIG. 1, the perimeter 55 of each disc 20 contains a multiplicity of circular apertures 18 in which the gas and liquid exits the discs 20 in a relative compressed state. In FIG. 6, the openings are rectangular in shape 22. Note, other shapes can be used for increasing the efficiency of the compressor 1. Affixed to the perimeter housing 27 is at least one gas/liquid exit conduit 25 with opening 24 for allowing the liquid and compressed gas to exit the high pressure chamber 21 of the compressor 1.

Figure 2:
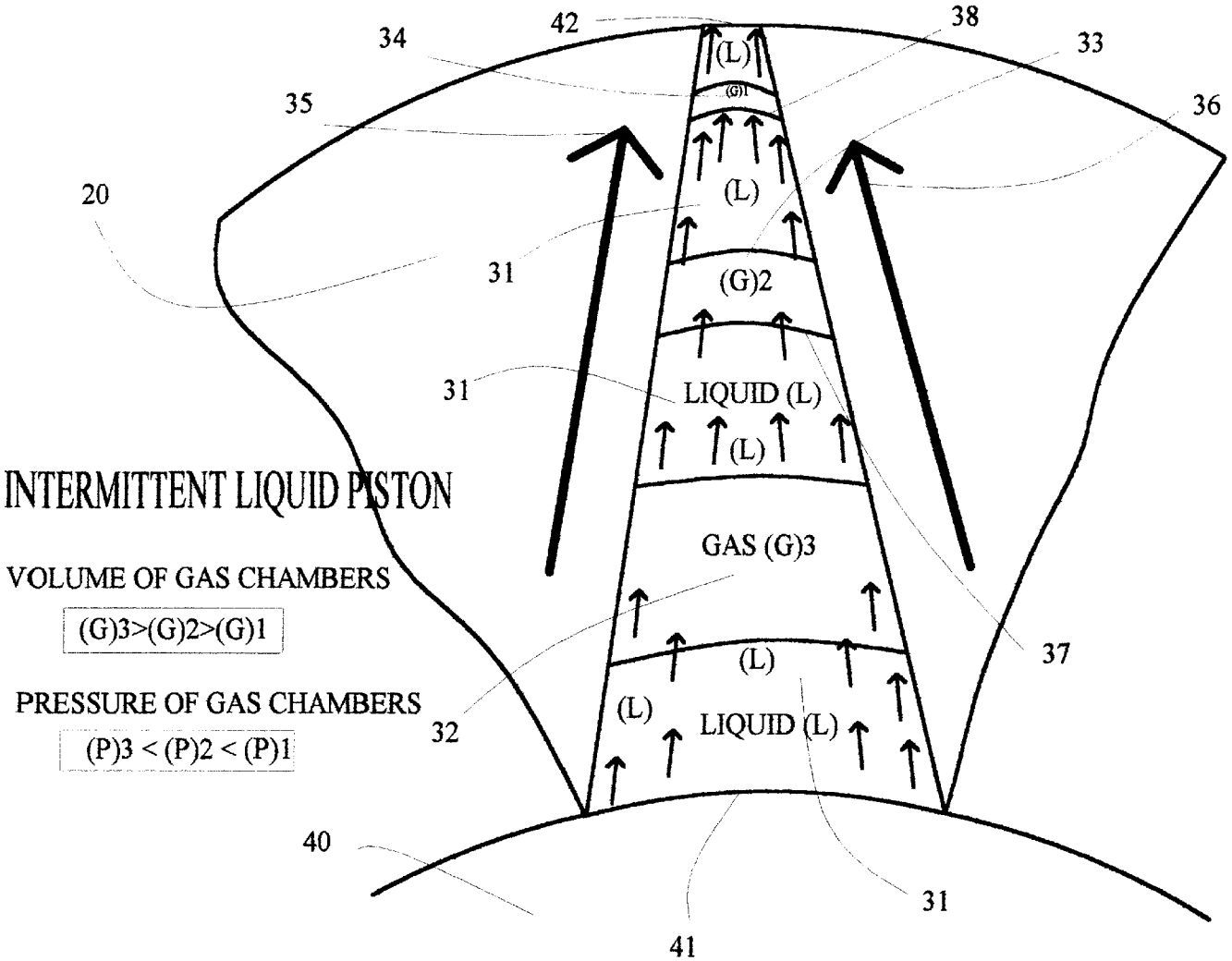
FIG. 2 shows a side cut-away view of the conduit for how gases are compressed by intermittent liquid pistons travelling down the conduit.
Figure 7:
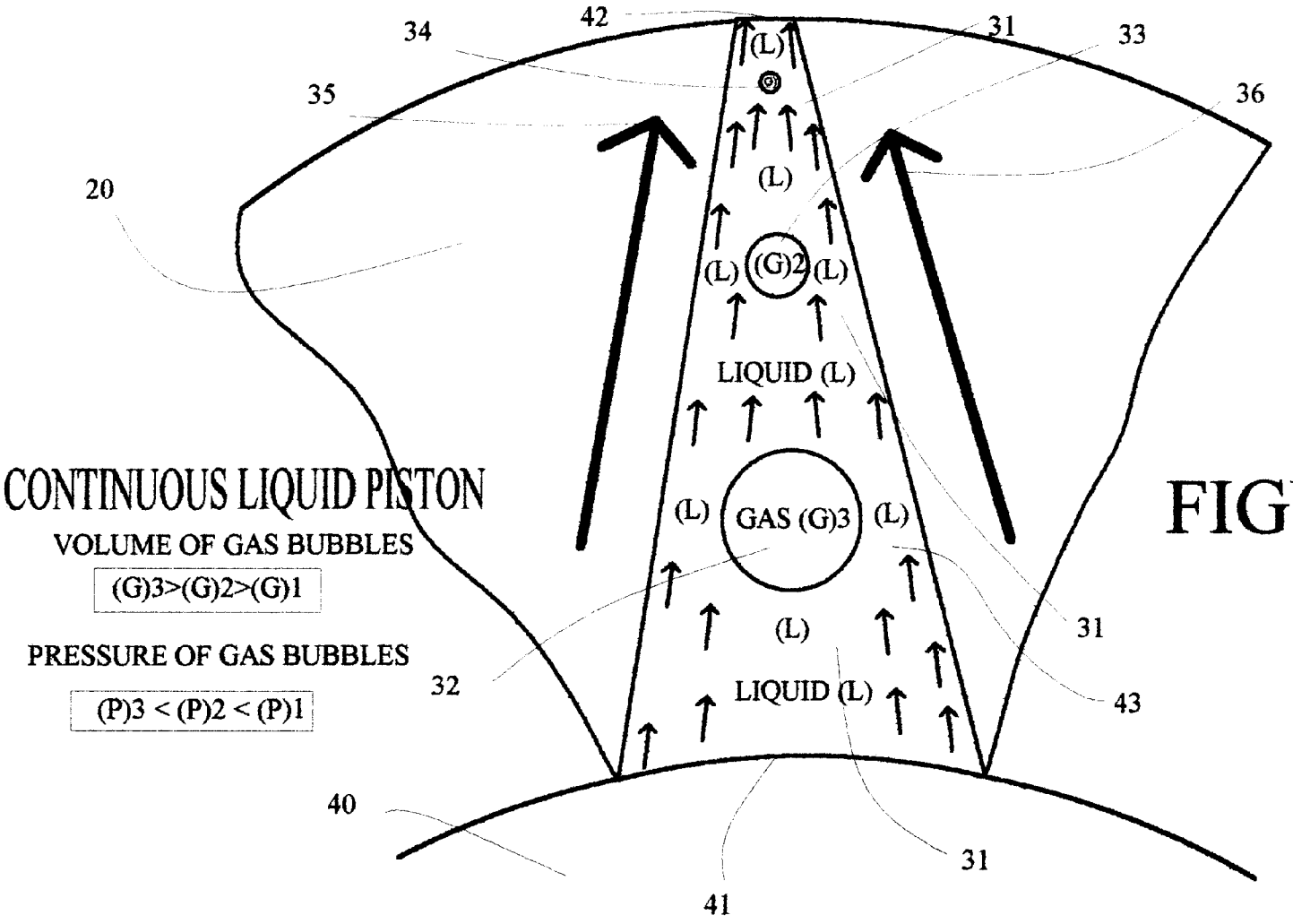
FIG. 7 shows a side cut-away view of the conduit for how gases are compressed by a continuous liquid piston travelling down the length of the conduit.

FIGS. 2 and 7 show a top and cross section view of a conduit 43 inside a disc 20. The assumption in the Figures is that the discs 20 are in a spinning state and both liquids and gases are flowing through the conduit 43. In FIG. 2, there are intermittent sections of the conduit 43 having both liquid sections 31 and gases sections 32, 33, and 34. Note, the gas sections 32, 33, 34, decrease in volume as they get closer to the perimeter 55 of the disc 20. The volume of the liquid sections 31 remain the same as the liquid sections 31 get closer to the perimeter 55 of the discs 20, assuming the liquid is noncompressible. Since the gas sections 32, 33, and 34 are compressed as they move towards the perimeter 55, they exit opening 42 in a higher pressurized state relative to the entrance pressurized state at opening 41. Note, the opening size 42 relative to the opening size 41 will significantly affect the relative pressure differential between the gases entering and exiting the discs 20.

FIG. 7 shows a continuous flow of gases in the form of bubbles traveling down the conduit 43. The gas bubbles enter the conduit at opening 41 and are compressed into a higher pressure state as they travel along the conduit 43. The higher pressure bubble then exit the conduit via opening 42 and enter the high pressure chamber 21. FIG. 2 and FIG. 7 perform the same end result, i.e., they compress gases from a low pressure state, to a high pressure state, however, FIG. 2 does it in an intermittent fashion, and FIG. 7 does it in a continues flow of bubble. The distributor design will greatly affect the manner in which the gases will be compressed along the conduit 43. Note, combinations of the manner in which gases are compressed can also be achieved by the distributor design.

Figure 3:
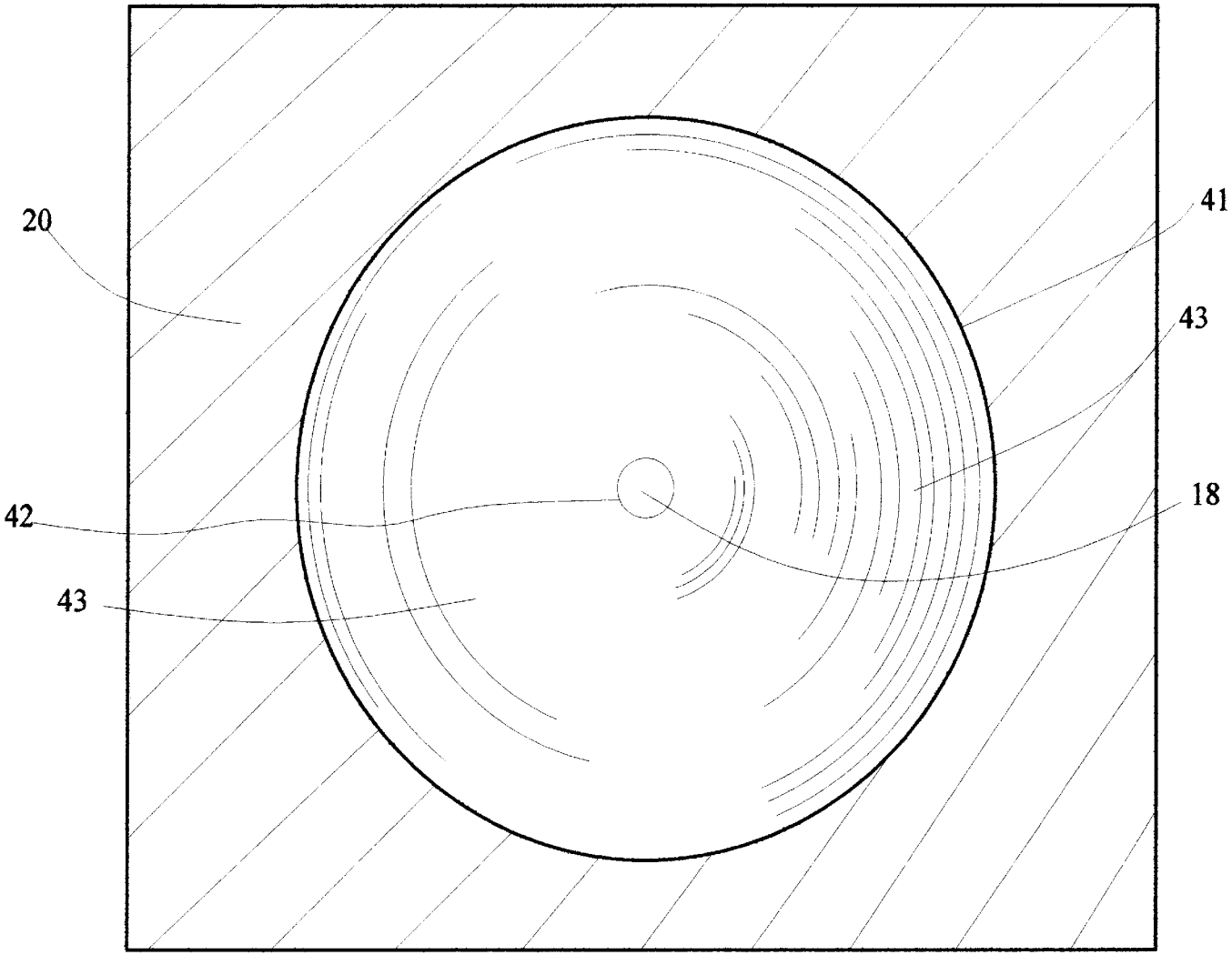
FIG. 3 shows an internal view of a circular conduit looking from the inside of the entrance opening down to the exit opening.
Figure 5:
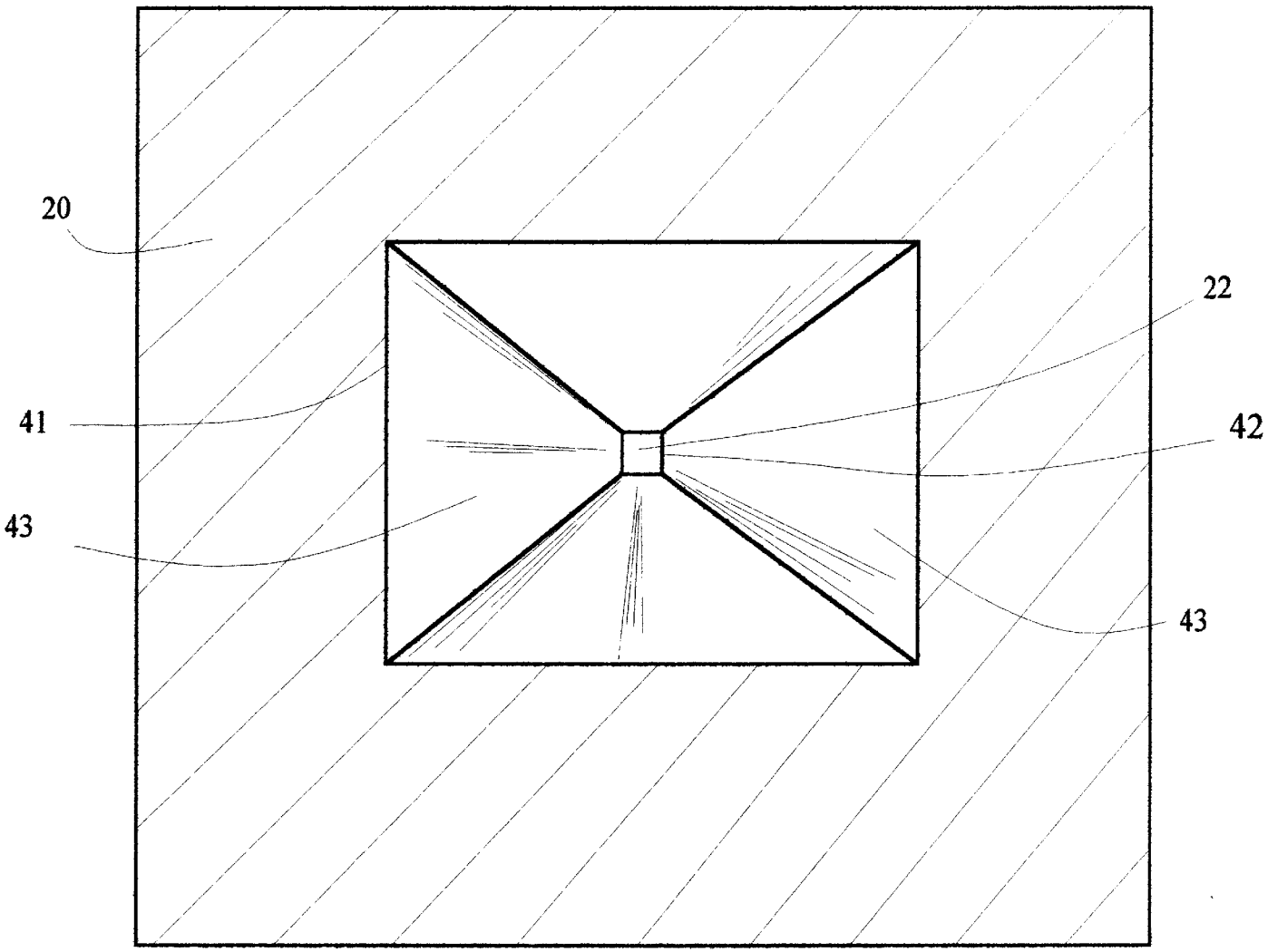
FIG. 5 shows an internal view of a rectangular conduit looking from the inside of the entrance opening down to the exit opening.

FIGS. 3 and 5 show the different simple variations in the conduit 43 design that can be integrated into the disc 20. FIG. 3 shows a circular design, while FIG. 5 shows a rectangular design. Both Figures show views looking from the inside of the entrance opening 41 down to the exit opening 42.

Figure 9:
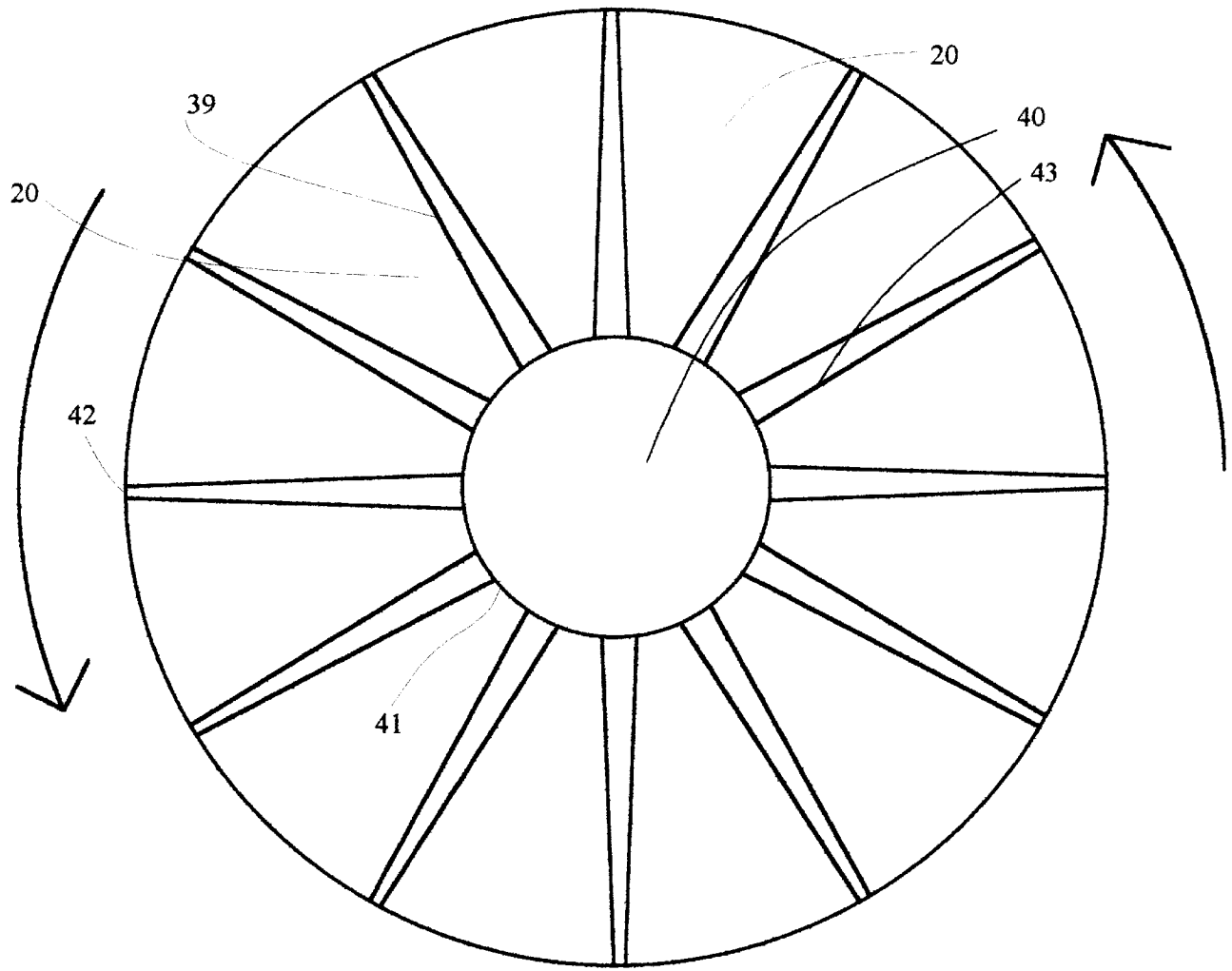
FIG. 9 shows a top cut-away view of a disc having a plurality of conduits for channeling liquid and gases from a central distribution location. The conduits have the common characteristic in that the openings at the entrance end are larger than the exit openings.
Figure 10:
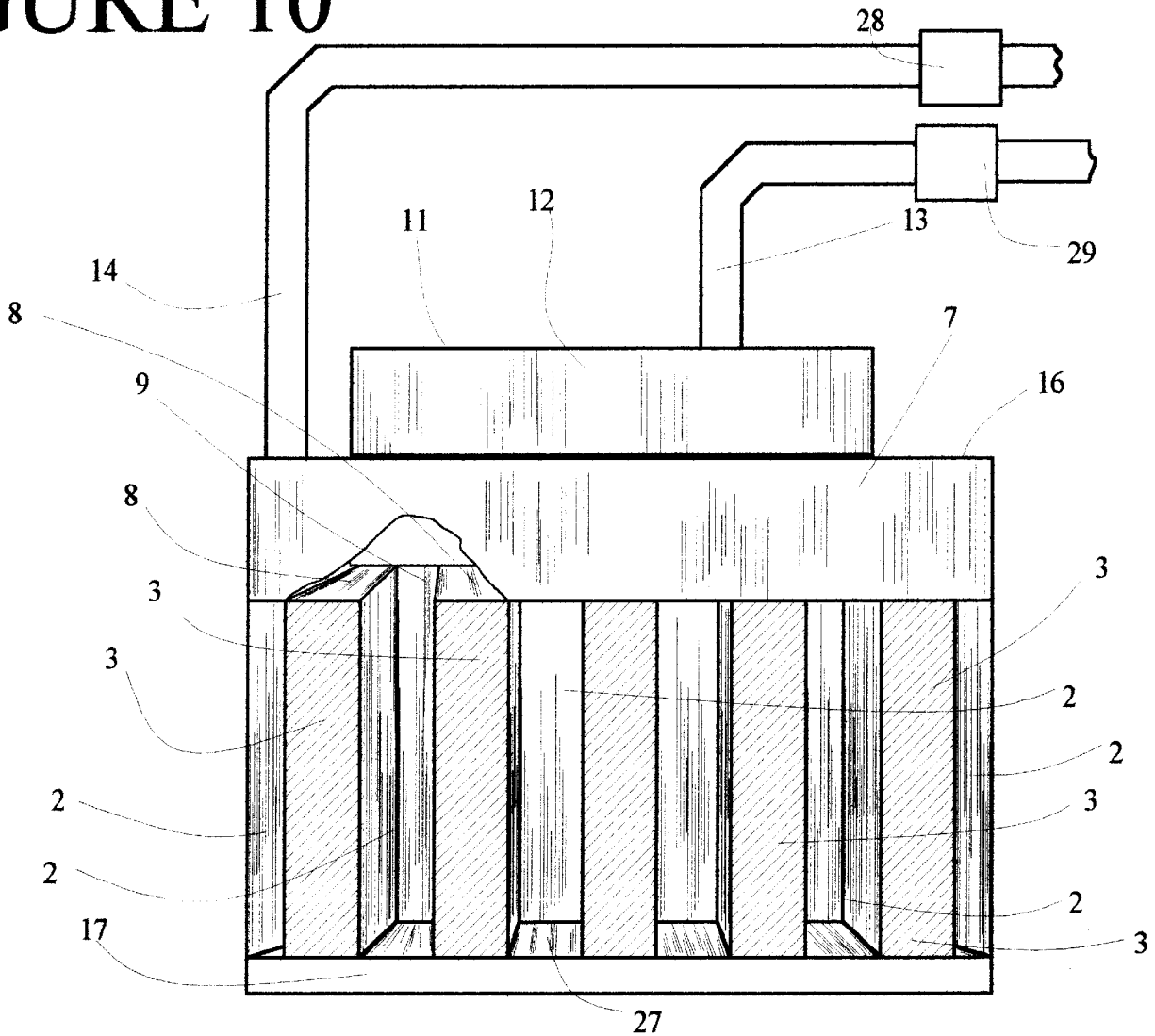
FIG. 10 shows a side cut-away view of the distributor, which contains a plurality of channels for intermittently distributing liquids and gases into the conduits.
Figure 11:
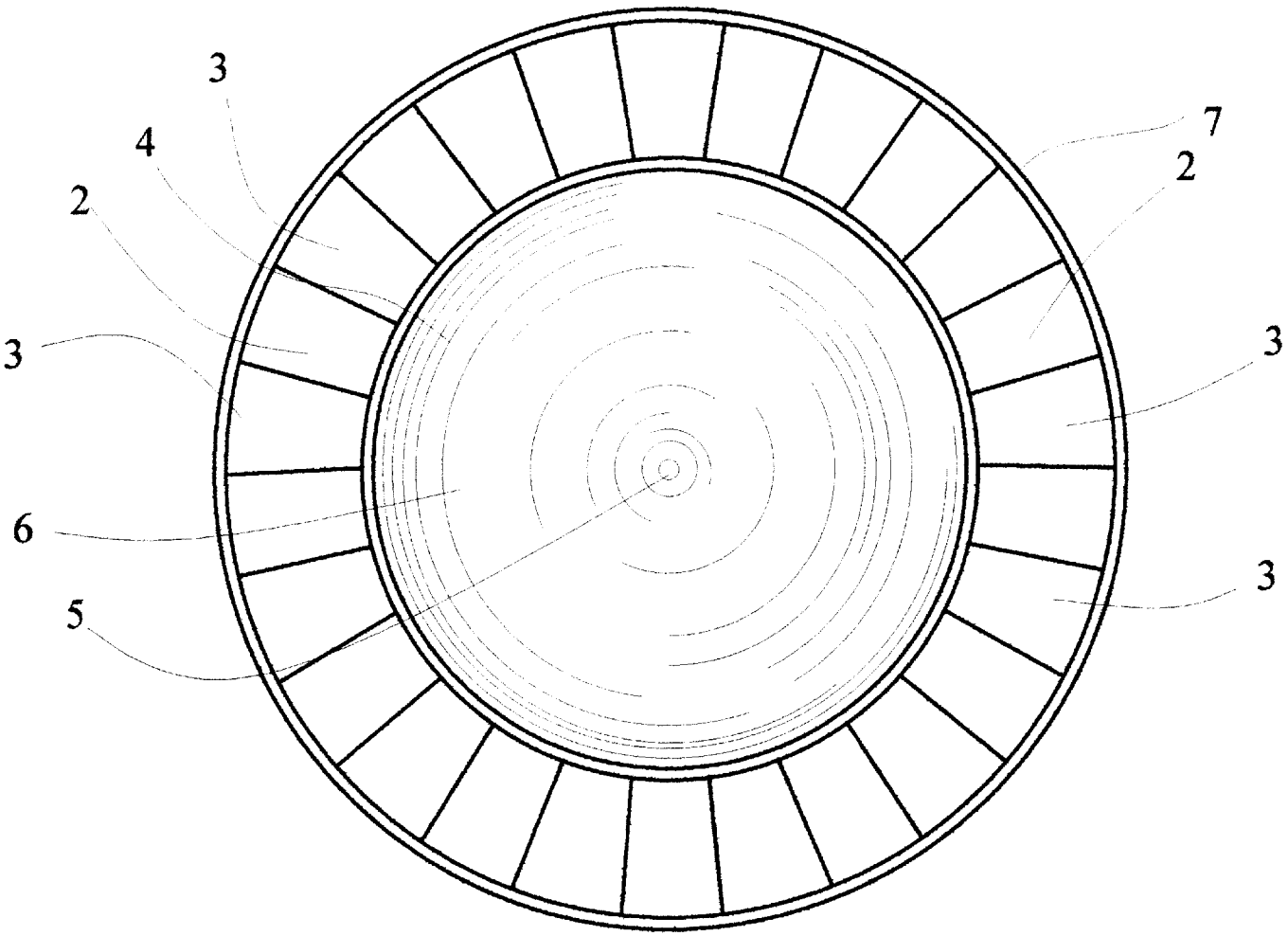
FIG. 11 shows a top cut-away view of the distributor, which contains a plurality of channels for intermittently distributing liquids and gases into the conduits.
Figure 12:
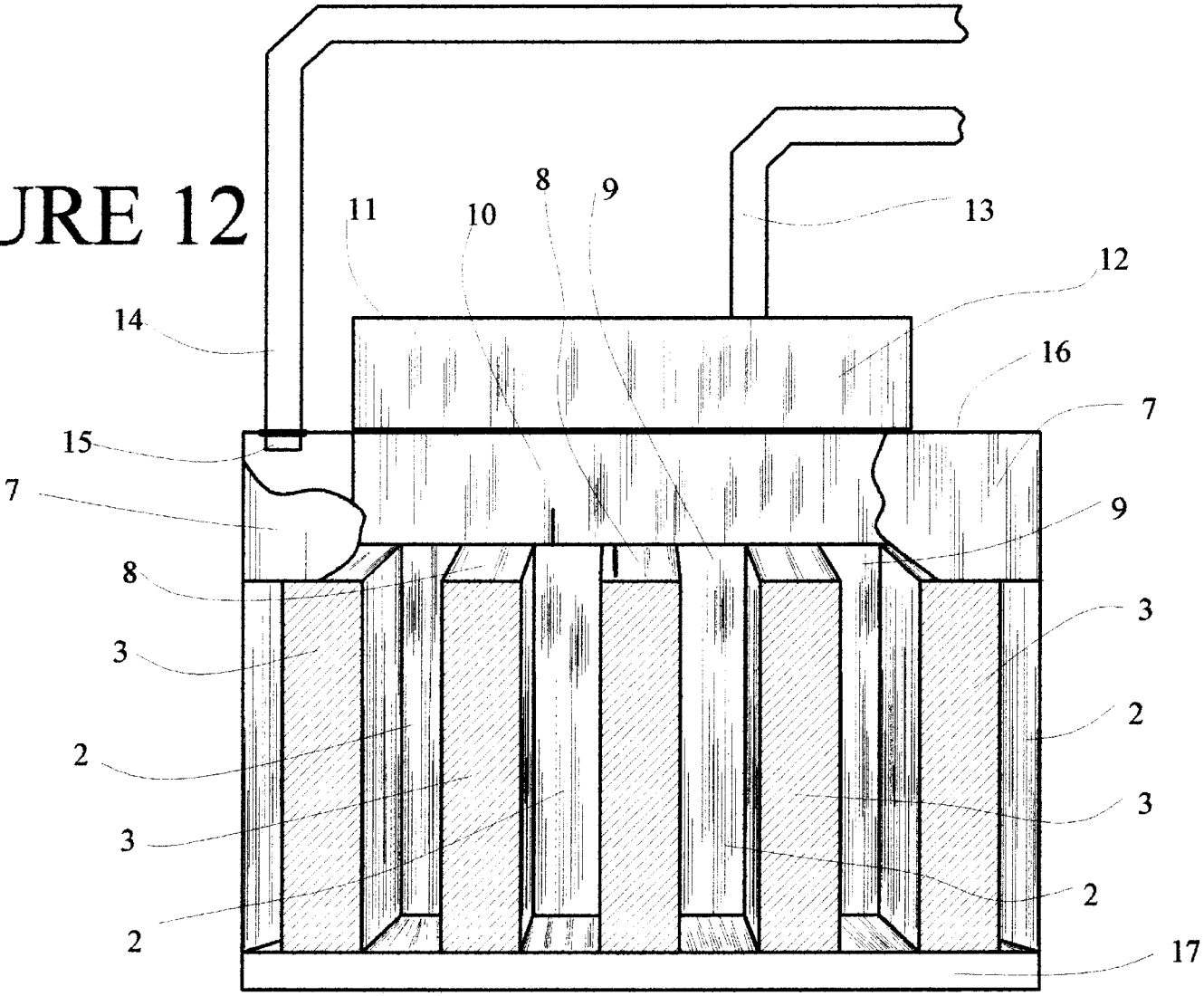
FIG. 12 shows a side cut-away view of the distributor, which contains a plurality of channels for intermittently distributing liquids and gases into the conduits. The gas chambers are cut-away to show how gas flows from the intake line into the plurality of gas channels.
Figure 13:
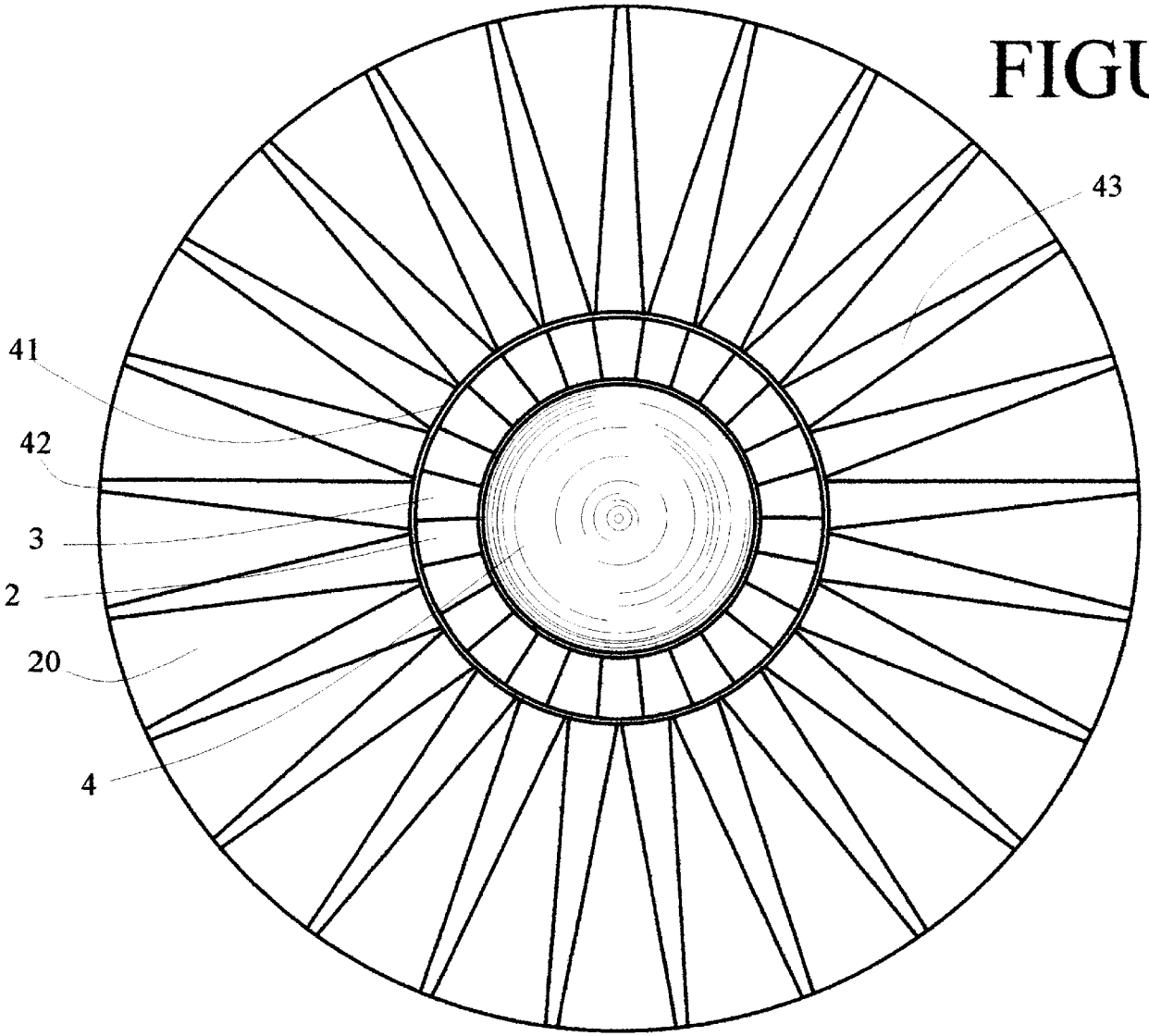
FIG. 13 shows a top cut-away view of a disc and distributor having a plurality of conduits for channeling liquid and gases from a central distribution location. The disc rotates relative to the stationary distributor.

FIGS. 9 11, and 13 show a top cross sectional view of the discs 20 alone, the distributor alone, and a combination of the two respectively. FIG. 9 simply shows the use of a plurality of conduits 43 equally spaced around the perimeter of the disc in an intermittent fashion. FIG. 11, is a FIG. 13 shows the same with the addition of the distributor having intermittent liquid 3 and gas 2 conduits. Note, in FIG. 13, the discs 20 spin relative to the stationary distributor and its liquid and gas conduits 3 and 2 respectively.

FIGS. 10, 11, 12, 13, and 14 show various cut-away views of the distributor and the inner chambers. The distributors primary purpose is to channel liquids and gasses in specific proportions and at specific rates into the channels 43 for compression. A simple distributor is shown in the Figures having a liquid inlet pipe entering a liquid chamber prior to entering the channels 43. Also, a separate gas inlet line entering a gas chamber prior to entering the channels 43. The distributor intermittently allows liquids and gasses to enter the channel 43 while the channels are in spinning motion. As the gases followed by the liquids travel along the channels toward the perimeter 55 they are compressed due to the smaller aperture at the exit. Thus, a higher pressure state is achieved for the gasses upon exit. The higher gasses exiting the channels 43 may be used for a multiplicity of applications.

Figure 14:
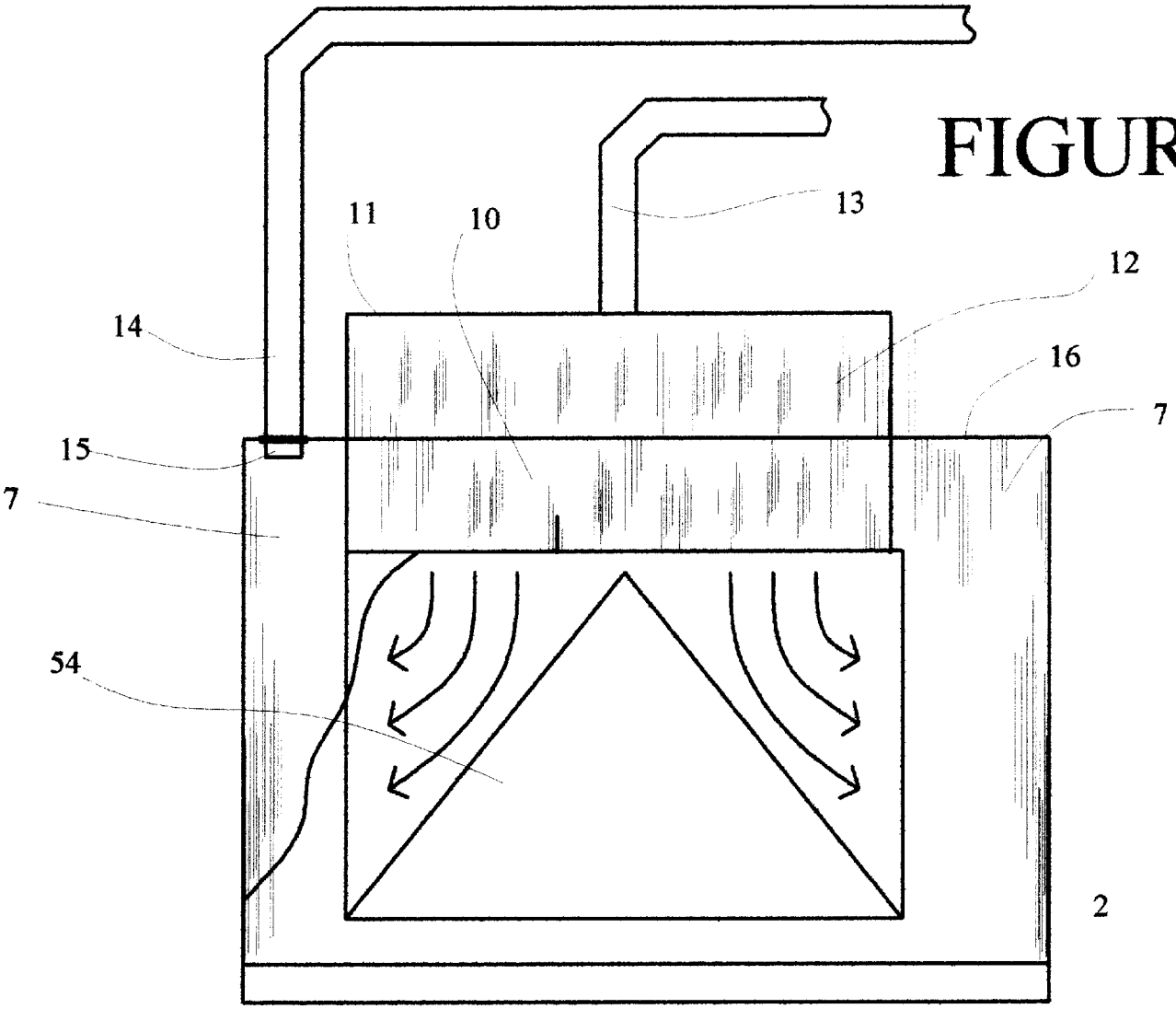
FIG. 14 shows a side cut-away view of the distributor, which contains a plurality of channels for intermittently distributing liquids and gases into the conduits. The liquid chamber is cut-away to show how liquid flows from the intake line into the plurality of liquid channels and is deflected by a conical deflector plate.

Deflector plates in FIG. 14 are shown strategically located inside of the distributor to decrease the impedance of the liquid and gas flow. It should be noted that various designs in the distributor can fulfill the primary intent of channeling liquid and gasses into the channels 43.

Figure 4:
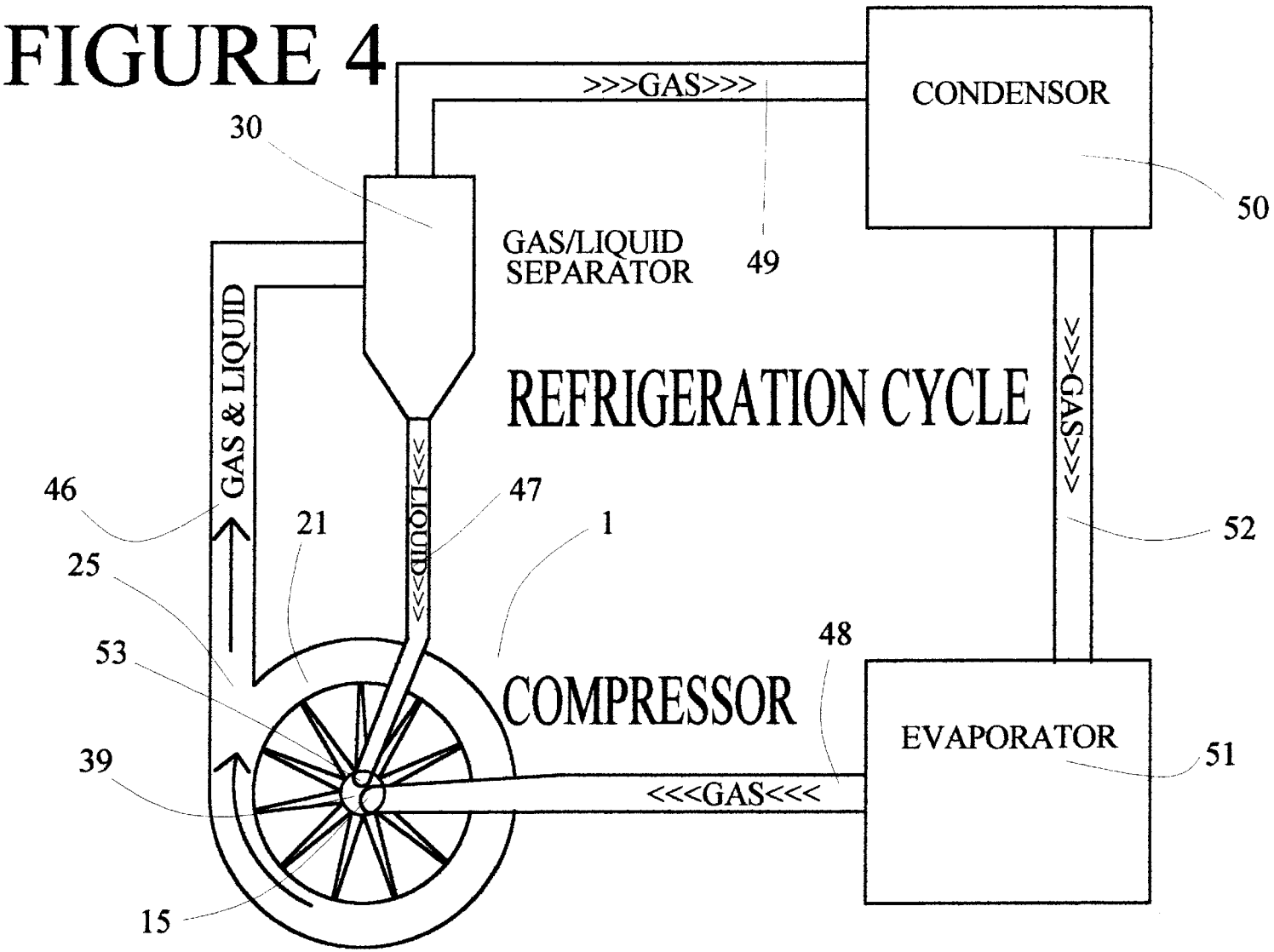
FIG. 4 shows a schematic view of an application for the compressor being used for a refrigeration cycle.
Figure 8:
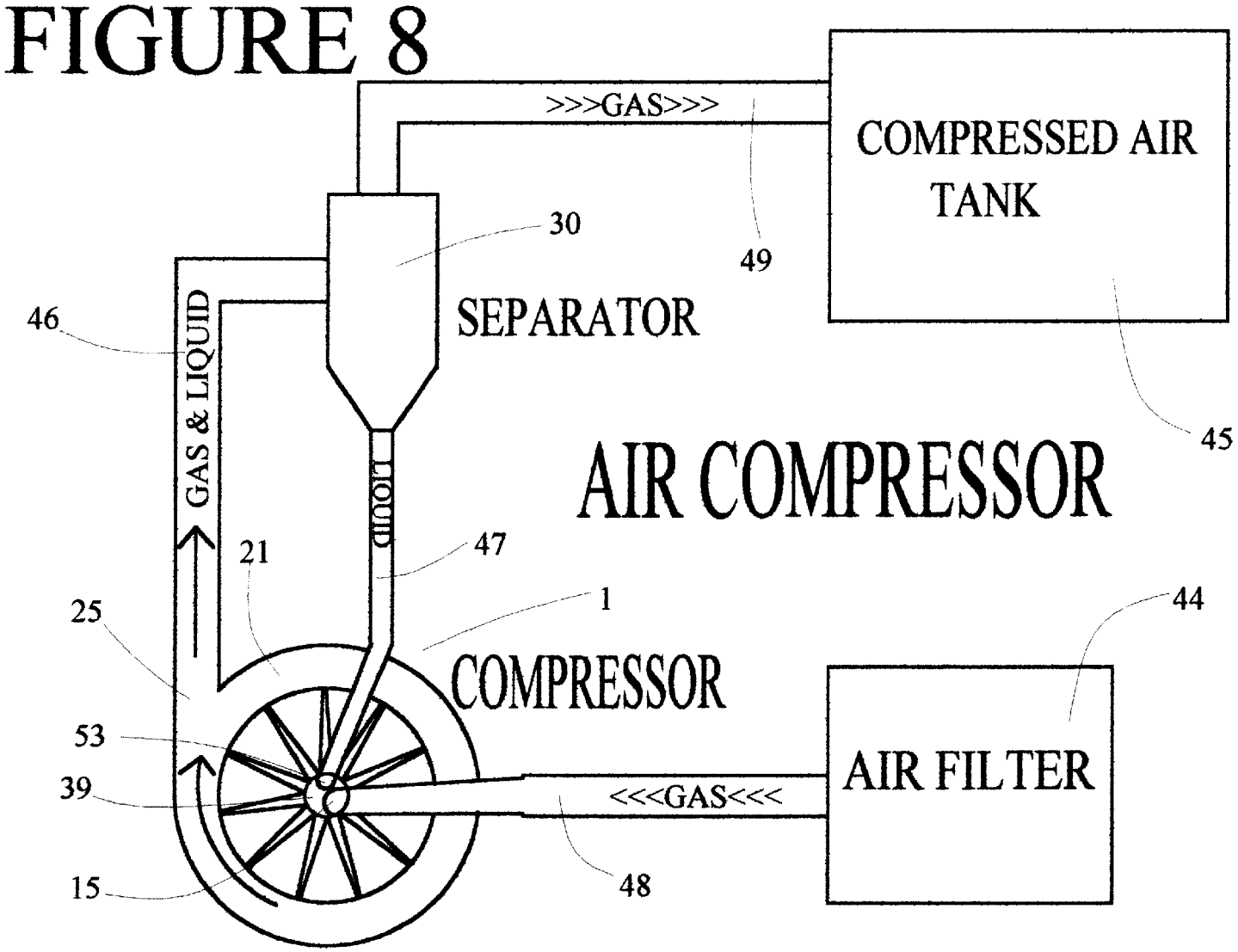
FIG. 8 shows a schematic view of an application for the compressor being used for an air compressor system.

Finally, in FIGS. 4 and 8, different applications in which the compressor may be used, from simple air compressors, to more complex high and low temp refrigeration systems.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A centrifuge gas compressor for compressing gases from to higher pressure states, said compressor comprising:

(a) housing having a hollow interior, a top opening, and a bottom opening (b) a distributor affixed to said housing through said top opening and extending inwards into said hollow interior, said distributor having a substantially round configuration, (c) at least one disc rotatably affixed to said distributor inside said hollow interior, said disc having a hollow central portion with a substantially round configuration, said central portion fitting around said round configuration of said distributor.

2. A centrifuge gas compressor for compressing gases from to higher pressure states as set forth in claim 1 wherein said distributor having at least one gas conduit.

3. A centrifuge gas compressor for compressing gases from to higher pressure states as set forth in claim 1 wherein said distributor having at least one liquid conduit.

4. A centrifuge gas compressor for compressing gases from to higher pressure states as set forth in claim 1 wherein said disc having at least one compression conduit extending perpendicular from a rotating axis of said disc, said compression conduit extending from said interior of said disc to the perimeter of said disc.

5. A centrifuge gas compressor for compressing gases from to higher pressure states as set forth in claim 4 wherein said compression conduit having a generally conical length wise shape.

6. A centrifuge gas compressor for compressing gases from to higher pressure states as set forth in claim 5 wherein said compression conduit having a generally circular cross section shape.

7. A centrifuge gas compressor for compressing gases from to higher pressure states as set forth in claim 5 wherein said compression conduit having a generally rectangular cross section shape.

8. A centrifuge gas compressor for compressing gases from to higher pressure states as set forth in claim 1 wherein said distributor having at least one gas conduit.

* * * * *